US005920185A

United States Patent [19]

Ozoe

[11] Patent Number: 5,920,185

[45] Date of Patent: Jul. 6, 1999

[54] CONSTANT-VOLTAGE CIRCUIT CAPABLE OF PREVENTING AN OVERSHOOT AT A CIRCUIT OUTPUT TERMINAL

[75] Inventor: Hidetoshi Ozoe, Kanagawa, Japan

[73] Assignee: NEC Corporation, Tokyo, Japan

[21] Appl. No.: 09/015,532

[22] Filed: Jan. 29, 1998

[30] Foreign Application Priority Data

Jan. 30, 1997 [JP] Japan ..... 9-016782

[51] Int. Cl.[6] ..... G05F 3/16

[52] U.S. Cl. ..... 323/315; 323/313

[58] Field of Search ..... 323/312, 313, 323/314, 315, 316

[56] References Cited

U.S. PATENT DOCUMENTS

| | | | |
|---|---|---|---|
| Re. 29,619 | 4/1978 | Pastoriza | 307/264 |
| 5,034,637 | 7/1991 | Jungert | 307/542 |
| 5,596,265 | 1/1997 | Wrathall et al. | 323/315 |
| 5,764,042 | 6/1998 | Beier et al. | 323/316 |

FOREIGN PATENT DOCUMENTS

| | | | |
|---|---|---|---|
| 64-29915 | 1/1989 | Japan | G05F 1/56 |
| 1-314319 | 12/1989 | Japan | G05F 3/16 |

*Primary Examiner*—Peter S. Wong
*Assistant Examiner*—Bao Q. Vu
*Attorney, Agent, or Firm*—Sughrue, Mion, Zinn, Macpeak & Seas, PLLC

[57] ABSTRACT

A constant-voltage circuit has a differential amplifier circuit and an output stage circuit. The differential amplifier circuit is supplied with a predetermined reference voltage and produces an amplifier voltage in accordance with the predetermined reference voltage. The output stage circuit has a circuit output terminal and outputs an output voltage from the circuit output terminal in response to the amplifier voltage. The constant-voltage circuit further comprises an overshoot preventing section and a supplying section. The supplying section supplies a control signal to the overshoot preventing section when the source voltage is supplied to the constant-voltage circuit. The overshoot preventing section prevents the overshoot at the circuit output terminal in response to the control signal to control the output voltage to the predetermined constant voltage.

8 Claims, 10 Drawing Sheets

CONSTANT-VOLTAGE CIRCUIT CAPABLE OF PREVENTING AN OVERSHOOT AT A CIRCUIT OUTPUT TERMINAL

BACKGROUND OF THE INVENTION

This invention relates to a constant-voltage circuit, more particularly, to a constant-voltage circuit capable of making an output voltage be stable without an overshoot at a circuit output terminal.

A constant-voltage circuit is for use in obtaining a constant-voltage as an output voltage. A conventional constant-voltage circuit comprises a differential amplifier circuit and an output stage circuit connected to the differential amplifier circuit and will be referred to a first conventional constant-voltage circuit. The output stage circuit may be further connected to an output load circuit at a circuit output terminal. When the differential amplifier circuit is supplied with a reference voltage, the output stage circuit outputs an output voltage as a constant-voltage. As will be described later, an overshoot inevitably occurs at the circuit output terminal in the first conventional constant-voltage circuit. Accordingly, it is difficult to make the output voltage be stable in the first conventional constant-voltage circuit.

In additional, it is known that a constant-voltage circuit is disclosed in Japanese Patent Publication Tokkai Syo 64-29915 (29915/1989) and will be referred to as a second conventional constant-voltage circuit.

Furthermore, it is known that a constant-voltage circuit is disclosed in Japanese Patent Publication Tokkai Hei 1-314319 (314319/1989) and will be referred to as a third conventional constant-voltage circuit.

As will be described later, an overshoot also occurs in each of the second and the third conventional constant-voltage circuits. Accordingly, it is difficult to make the output voltage be stable in each of the second and the third conventional constant-voltage circuits.

SUMMARY OF THE INVENTION

It is therefore an object of this invention to provide a constant-voltage circuit capable of making an output voltage be stable without an overshoot at a circuit output terminal.

Other objects of this invention will become clear as the description proceeds.

According to this invention, there is provided a constant-voltage circuit comprises differential amplifier means supplied with a predetermined reference voltage for producing an amplifier voltage in accordance with the predetermined reference voltage, output means having a circuit output terminal for outputting an output voltage from the circuit output terminal in response to the amplifier voltage, and preventing means for preventing an overshoot at the circuit output terminal to control the output voltage into a predetermined constant voltage when a source voltage is supplied to the constant-voltage circuit.

DESCRIPTION OF THE PREFERRED EMBODIMENTS

Figure 1:
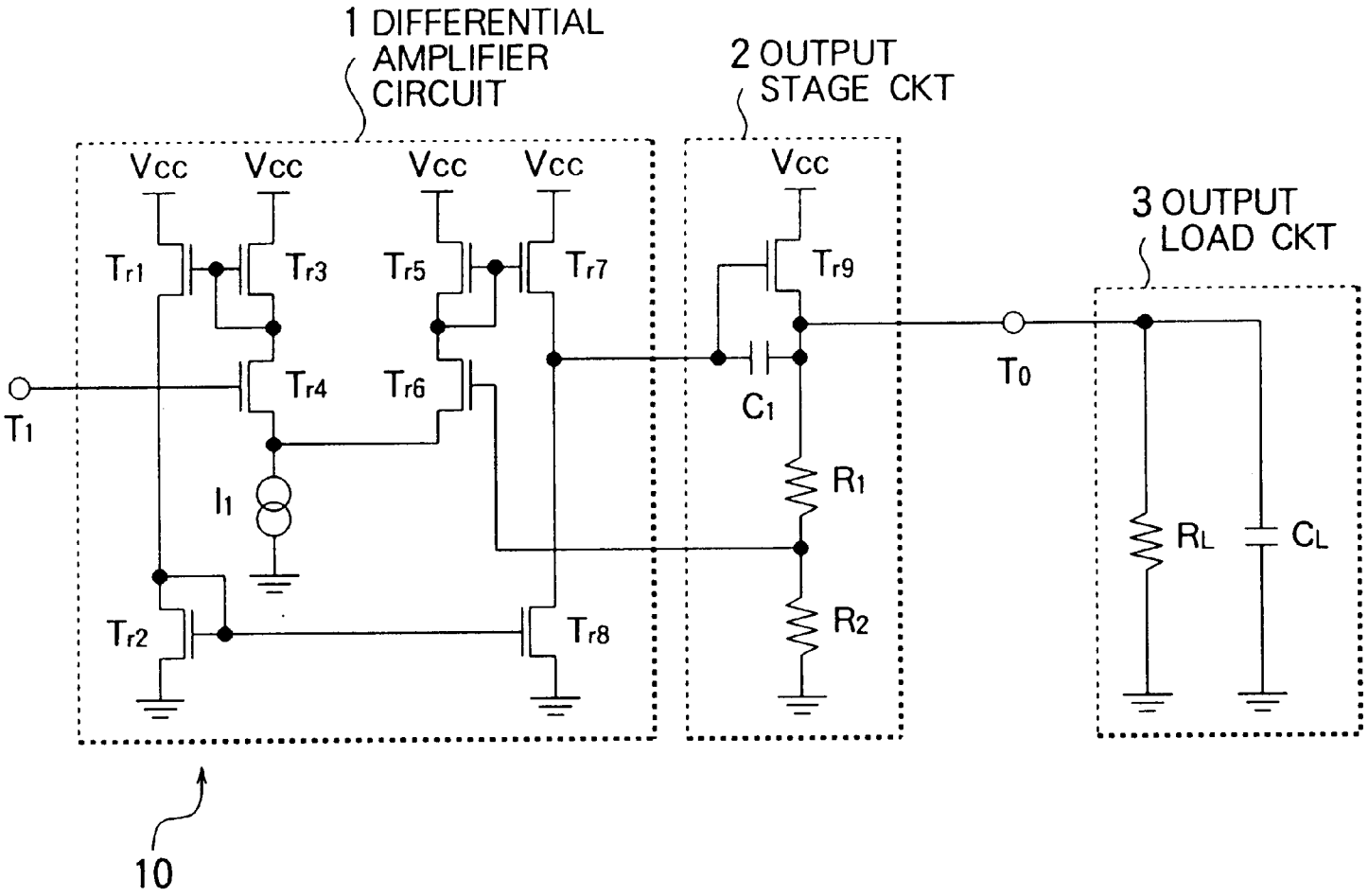
FIG. 1 PRIOR ART
FIG. 1 is a circuit diagram of a first conventional constant-voltage circuit.

Referring to FIG. 1, a first conventional constant-voltage circuit 10 will be described at first in order to facilitate an understanding of this invention. The first conventional constant-voltage circuit 10 comprises a differential amplifier circuit 1 and an output stage circuit 2 connected to the differential amplifier circuit 1. In the example being illustrated, the output stage circuit 2 is connected to an output load circuit 3.

The differential amplifier circuit 1 comprises first through eighth metal-oxide semiconductor (MOS) transistors Tr1 to Tr8 and a constant-current element which flows a constant current I1. As a matter of convenience, the constant-current element is referred by a reference symbol I1. The differential amplifier circuit 1 has a circuit input terminal T1 to which a reference voltage VREF is applied. Furthermore, the differential amplifier circuit 1 is supplied with a source voltage Vcc.

The output stage circuit 2 comprises a p-channel metal-oxide semiconductor (PMOS) transistor Tr9, first and second resistors and a capacitor. The first and the second resistors have first and second resistances R1 and R2, respectively. The capacitor has a capacitance C1. As a matter of convenience, the first and the second resistors are referred by reference symbols R1 and R2, respectively. The capacitor is referred by a reference symbol C1. The output stage circuit 2 has a circuit output terminal To from which an output voltage is outputted as a constant voltage VREG. The output stage circuit 2 is supplied with the source voltage Vcc.

In the example being illustrated, the output load circuit 3 comprises a load resistor and a load capacitor. The load resistor and the load capacitor have a load resistance RL and a load capacitance CL, respectively. As a matter of convenience, the load resistor and the load capacitor are referred by reference symbols RL and CL.

The illustrated constant-voltage circuit 10 is operable as a negative-feedback amplifier circuit. More particularly, the differential amplifier circuit 1 is operable as a voltage follower circuit so that the sixth MOS transistor Tr6 has a gate potential equal to the reference voltage VREF inputted from the circuit input terminal T1. The output voltage VREG is given by VREF×(R1+R2)/R2. Just after the source voltage is supplied with the constant-voltage circuit 10, the PMOS transistor Tr9 becomes a conductive state inasmuch as the PMOS transistor Tr9 has a gate potential which is equal to the ground potential. As a result, an output current flows to the circuit output terminal To through the PMOS transistor Tr9.

The differential amplifier circuit 1 operates so as to suppress the output current. When the output voltage is not less than a voltage of a steady state, it is difficult for the differential amplifier circuit 1 to suppress the output current inasmuch as a feedback voltage is delayed which is supplied to the gate of the PMOS transistor Tr9. As a result, an overshoot may occur at the output terminal To on the basis of the output current. The output current flows to the ground through the first and the second resistors R1 and R2. The output voltage converges to the voltage of the steady state.

In the first conventional constant-voltage circuit, the PMOS transistor Tr9 has the gate potential equal to the ground potential just after the source voltage Vcc is supplied to the constant-voltage circuit. As a result, the PMOS transistor Tr9 can supply a large current to the circuit output terminal To. On the other hand, the differential amplifier circuit 1 has a small circuit current. Therefore, it is difficult for the differential amplifier circuit 1 to suppress the current of the PMOS transistor Tr9. The overshoot occurs at the circuit output terminal To as described above.

In addition, each of the first and the second resistances R1 and R2 is large. Therefore, it takes a long time duration to converge the output voltage to the voltage of the steady state when the overshoot occurs at the circuit output terminal To.

Figure 2:
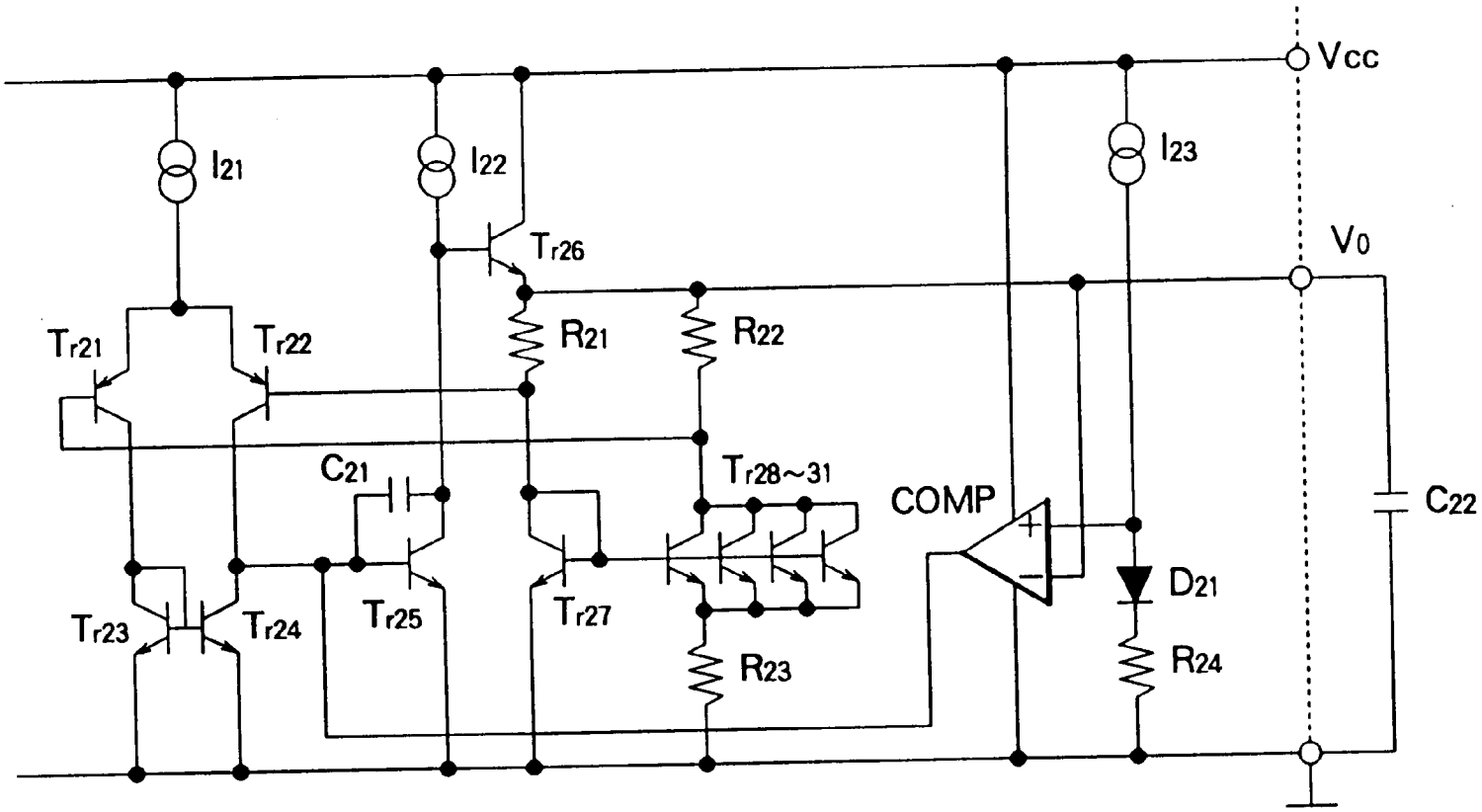
FIG. 2 PRIOR ART
FIG. 2 is a circuit diagram of a second conventional constant-voltage circuit.

Referring to FIG. 2, description will be made as regards a second conventional constant-voltage circuit. The illustrated constant-voltage circuit comprises first through third constant-current sources, first and second PNP transistors Tr21 and Tr22, first through ninth NPN transistors Tr23 to Tr31, a circuit capacitor, a voltage comparator circuit COMP, a diode D21, and first through fourth resistors. The constant-voltage circuit is connected to a load capacitor having a capacitance C22.

The first through the third constant-current sources generate constant-currents I21 to I23, respectively. As a matter of convenience, the first through the third constant-current sources are referred by reference symbols I21 to I23, respectively. Similarly, the circuit capacitor has a capacitance C21 and will be referred by a reference symbol C21. The first through fourth resistors have first through the fourth resistances R21 to R24, respectively. As a matter of convenience, the first through fourth resistors will be referred by reference symbols R21 to R24, respectively. In addition, the load capacitor will be referred by a reference symbol C22.

In the example being illustrated, the load capacitor C22 is supplied with an output voltage Vo from the constant-voltage circuit. In the second conventional constant-voltage circuit, the output voltage Vo is equal to the ground potential just after the source voltage Vcc is supplied to the constant-voltage circuit. As a result, a minute initial circuit current flows in the constant-voltage circuit. On the basis of the minute initial circuit current, the output voltage Vo slowly rises so that it takes a long time duration to reach a constant voltage. In order to improve the above-mentioned problem, the constant-voltage circuit comprises the sixth through the ninth NPN transistors Tr28 to Tr31. By the sixth through the ninth NPN transistors Tr28 to Tr31, the output voltage Vo quickly rises so that it takes a short time duration to reach a predetermined voltage equal to the constant voltage.

However, a current overshoot may occur at an output terminal of the constant-voltage circuit just after the source voltage Vcc is supplied with the constant-voltage circuit, when all of transistors are MOS transistors in the second conventional constant-voltage circuit.

Figure 3:
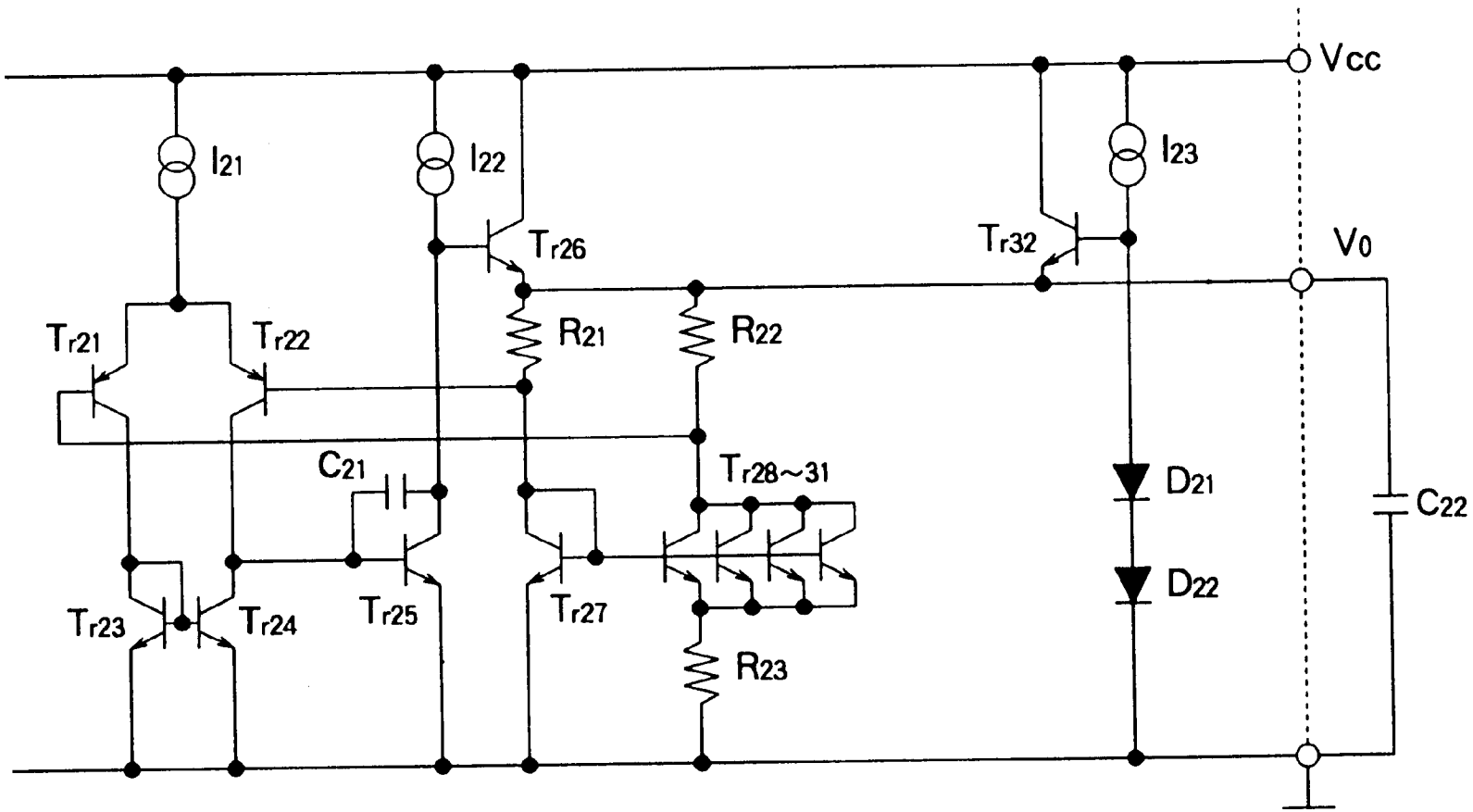
FIG. 3 PRIOR ART
FIG. 3 is a circuit diagram of a third conventional constant-voltage circuit.

Referring to FIG. 3, description will be made as regards a third conventional constant-voltage circuit. The third conventional constant-voltage circuit is different in structure from the second conventional constant-voltage circuit illustrated in FIG. 2. The third conventional constant-voltage circuit comprises similar parts which are designated by like reference symbols. Instead of the voltage comparator circuit COMP and fourth resistor R24, the third conventional constant-voltage circuit comprises a tenth NPN transistor Tr32 and a diode D22. In the example being illustrated, the load capacitor C22 is supplied with the output voltage Vo from the constant-voltage circuit. In the third conventional constant-voltage circuit, the output voltage Vo is equal to the ground potential just after the source voltage Vcc is supplied to the constant-voltage circuit. As a result, the minute initial circuit current flows in the constant-voltage circuit. On the basis of the minute initial circuit current, the output voltage Vo slowly rises so that it takes a long time duration to reach the constant voltage. In order to improve the above-mentioned problem, the constant-voltage circuit comprises the sixth through the ninth NPN transistors Tr28 to Tr31. By the sixth through the ninth NPN transistors Tr28 to Tr31, the output voltage Vo quickly rises so that it takes a short time duration to reach the predetermined voltage equal to the constant voltage.

However, the current overshoot may occur at the output terminal of the constant-voltage circuit just after the source voltage Vcc is supplied to the constant-voltage circuit, when all of transistors are MOS transistors in the second conventional constant-voltage circuit.

Figure 4:
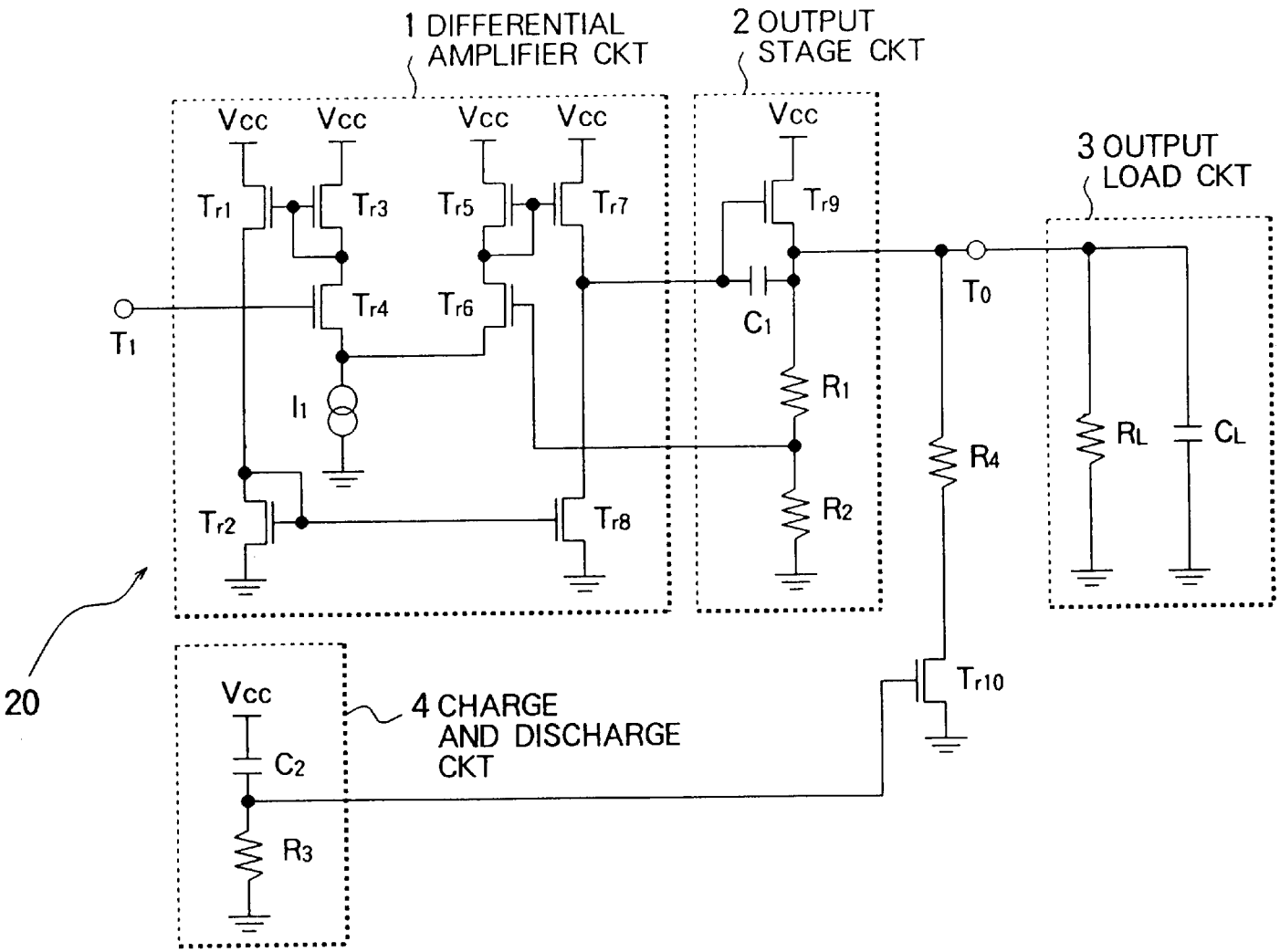
FIG. 4 is a circuit diagram of a constant-voltage circuit according to a first embodiment of this invention.

Referring to FIG. 4, description will proceed to a constant-voltage circuit according to a first embodiment of this invention. The illustrated constant-voltage circuit is different in structure from the constant-voltage circuit 10 illustrated in FIG. 1 and is therefore designated afresh by a reference numeral 20. The constant-voltage circuit 20 comprises similar parts which are designated by like reference symbols. The constant-voltage circuit 20 comprises the differential amplifier circuit 1 and the output stage circuit 2 which is connected to the output load circuit 3. The constant-voltage circuit 20 further comprises a charge and discharge circuit 4. The charge and discharge circuit 4 is connected to the circuit output terminal To through an NMOS transistor Tr10 and an additional resistor having a resistance R4. As a matter of convenience, the additional resistor will be referred by a reference symbol R4.

More particularly, the charge and discharge circuit 4 comprises a primary resistor and a primary capacitor which are connected in series to each other. The primary resistor and the primary capacitor have a primary resistance R3 and a primary capacitance C2, respectively. As a matter of convenience, the primary resistor and the primary capacitor will be referred by reference symbols R3 and C2. The primary resistor R3 is connected to the ground. The primary capacitor C2 is connected to the source voltage Vcc. The gate of the NMOS transistor Tr10 is connected to a connection point between the primary resistor R3 and the primary capacitor C2.

The illustrated constant-voltage circuit 20 is operable as a negative-feedback amplifier circuit as described in conjunction with FIG. 1. More particularly, the differential amplifier circuit 1 is operable as a voltage follower circuit differential amplifier circuit 1 controls the sixth MOS transistor Tr6 in response to the variation of the output voltage so that the sixth MOS transistor Tr6 has a gate potential equal to the reference voltage VREF inputted from the circuit input terminal T1. As a result, the PMOS transistor Tr9 makes the output voltage VREG, given by VREF×R1/(R1+R2). A ground current flows to the ground through the additional resistor R4 and the NMOS transistor Tr10. As will be described later, the amount of the ground current is controlled in accordance with a control voltage which is supplied from the charge and discharge circuit 4 to the gate of the NMOS transistor Tr10. When the source voltage Vcc is supplied to the constant-voltage circuit 20, the PMOS transistor Tr9 becomes a conductive state inasmuch as the PMOS transistor Tr9 has a gate potential which is equal to the ground potential. As a result, an output current flows to the circuit output terminal To through the PMOS transistor Tr9.

Just after the constant-voltage circuit 20 is put into operation, the gate potential of the PMOS transistor Tr9 is equal to the ground potential. Therefore, the PMOS transistor Tr9 becomes a conductive state. An output current flows to the output terminal To through the PMOS transistor Tr9. Inasmuch as the output current continues to flow to the output terminal To until the current of the PMOS transistor Tr9 is suppressed by the differential amplification circuit 1, the overshoot of the output current occurs at the output terminal To. In order to prevent the overshoot, the constant-voltage circuit 20 has the charge and discharge circuit 4. More particularly, the primary capacitor C2 makes the gate potential of the NMOS transistor Tr10 become the source voltage Vcc. In other words, the charge discharge circuit 4 supplies the gate of the NMOS transistor Tr10 with the control voltage equal to the source voltage Vcc. As a result, the NMOS transistor Tr10 becomes a conductive state. The electric charges are discharged to the ground through the additional resistor R4 and the NMOS transistor Tr10. The output voltage becomes a voltage of a steady state after a short time duration lapses. The short time duration is determined by the additional resistance R4. The charge and discharge circuit 4 has a time constant determined by primary capacitor C2 and the primary resistance R3. The time constant is established in accordance with the short time duration. In the example being illustrated, the time constant is equal to the short time duration. Therefore, the control voltage becomes a voltage less than the source voltage Vcc after the short time duration lapses. The NMOS transistor Tr10 becomes a non-conductive state when the control voltage becomes a voltage less than the source voltage Vcc. Inasmush as the gate potential of the NMOS transistor Tr10 gradually falls in accordance with the above-mentioned time constant determined by the primary capacitance C2 and the primary resistance R3, the output voltage smoothly transfer to the voltage of the steady state without a noise based on the switching of the NMOS transistor Tr10.

Figure 5:
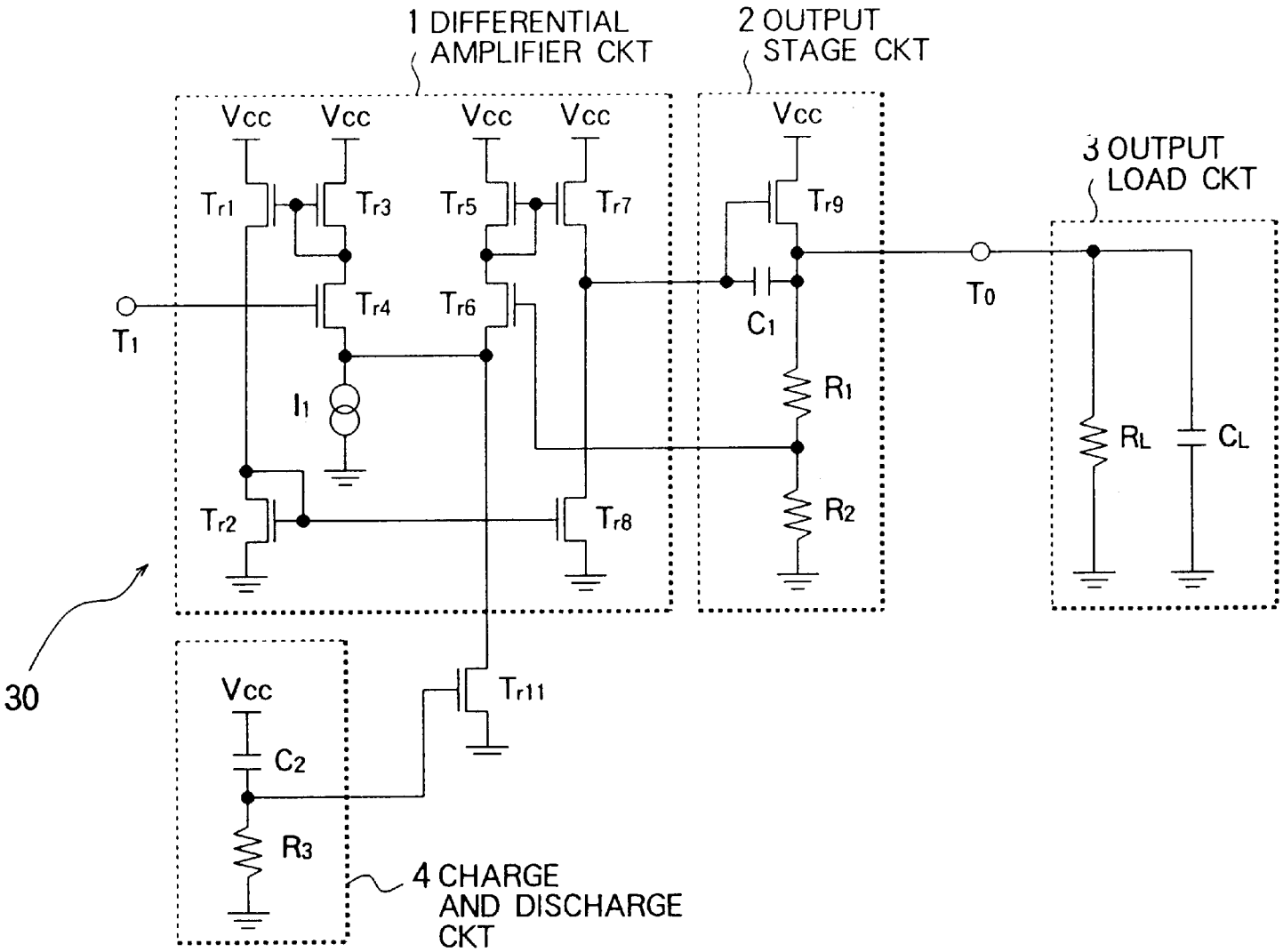
FIG. 5 is a circuit diagram of a constant-voltage circuit according to a second embodiment of this invention.

Referring to FIG. 5, description will proceed to a constant-voltage circuit according to a second embodiment of this invention. The illustrated constant-voltage circuit is different in structure from the constant-voltage circuit 20 illustrated in FIG. 1 and is therefore designated afresh by a reference numeral 30. The constant-voltage circuit 30 comprises similar parts which are designated by like reference symbols. The constant-voltage circuit 30 comprises an NMOS transistor Tr11 instead of the NMOS transistor Tr10 and the additional resistor R4 illustrated in FIG. 4. The charge and discharge circuit 4 is connected to the gate of the NMOS transistor Tr11. The drain of the NMOS transistor Tr11 is connected to the fourth and the sixth MOS transistors Tr4 and Tr6 as illustrated in FIG. 5. The source of the NMOS transistor Tr11 is connected to the ground.

As described in conjunction with FIG. 4, the illustrated constant-voltage circuit 30 is operable as a negative-feedback amplifier circuit. More particularly, the differential amplifier circuit 1 is operable as the voltage follower circuit. The differential amplifier circuit 1 controls the sixth MOS transistor Tr6 in response to the variation of the output voltage so that the sixth MOS transistor Tr6 has the gate potential equal to the reference voltage VREF inputted from the circuit input terminal Ti. As a result, the PMOS transistor Tr9 makes output voltage VREG be given by VREF×R1/(R1+R2).

Just after the constant-voltage circuit 20 is put into operation, the primary capacitor C2 makes the gate potential of the NMOS transistor Tr11 become the source voltage Vcc. In other words, the charge and discharge circuit 4 supplies the gate of the NMOS transistor Tr11 with the control voltage equal to the source voltage Vcc. As a result, the NMOS transistor Tr11 becomes a conductive state. When the NMOS transistor Tr11 becomes the conductive state, the circuit current increases in the differential amplifier circuit 1. When the circuit current increases in the differential amplifier circuit 1, the PMOS transistor Tr9 quickly becomes the conductive state so that the output voltage becomes the voltage of the steady state. In other words, the output voltage becomes the voltage of the steady state after the short time duration lapses.

As described in conjunction with FIG. 4, the time constant of the charge and discharge circuit 4 is established in accordance with the short time duration. In the example being illustrated, the time constant is equal to the short time duration. The control voltage becomes the voltage less than the source voltage Vcc after the short time duration lapses. Therefore, the NMOS transistor Tr11 becomes a non-conductive state when the control voltage becomes the voltage less than the source voltage Vcc. Inasmuch as the gate potential of the NMOS transistor Tr11 gradually falls in accordance with the time constant determined by the primary capacitance C2 and the primary resistance R3, the output voltage smoothly transfers to the voltage of the steady state without a noise based on the switching of the NMOS transistor Tr10.

Figure 6:
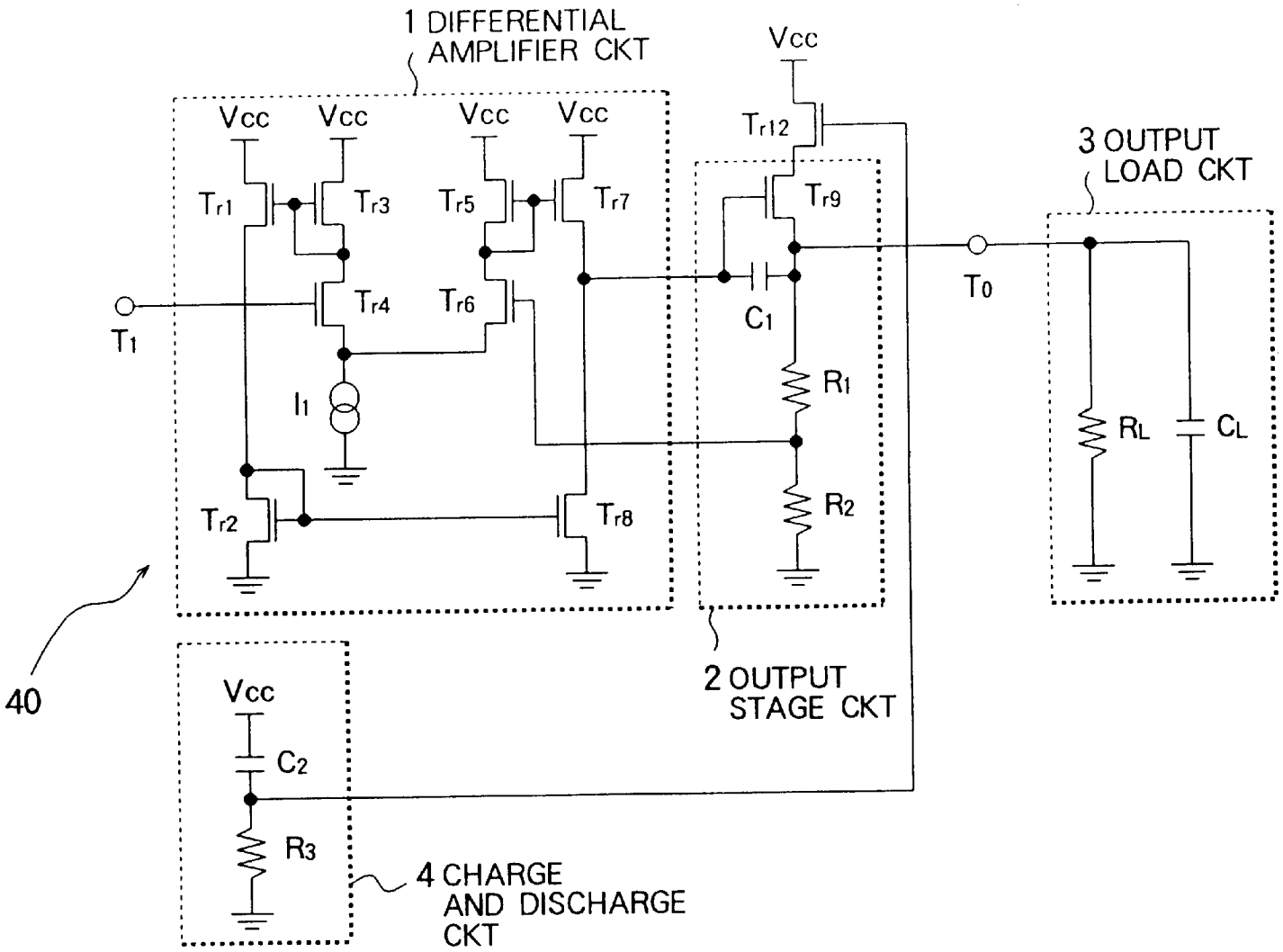
FIG. 6 is a circuit diagram of a constant-voltage circuit according to a third embodiment of this invention.

Referring to FIG. 6, description will proceed to a constant-voltage circuit according to a third embodiment of this invention. The illustrated constant-voltage circuit is different in structure from the constant-voltage circuit 20 illustrated in FIG. 4 and is therefore designated afresh by a reference numeral 40. The constant-voltage circuit 40 comprises similar parts which are designated by like reference symbols. The constant-voltage circuit 40 comprises a PMOS transistor Tr12 instead of the NMOS transistor Tr10 illustrated in FIG. 4. The charge and discharge circuit 4 is connected to the gate of the PMOS transistor Tr12. The drain of the PMOS transistor Tr12 is connected to the source of the PMOS transistor Tr9. The source of the PMOS transistor Tr12 is connected to the source voltage.

The illustrated constant-voltage circuit 40 outputs the output voltage as described in conjunction with FIG. 4.

Just after the constant-voltage circuit 40 is put into operation, the primary capacitor C2 makes the gate potential of the PMOS transistor Tr12 become the source voltage Vcc. In other words, the charge and discharge circuit 4 supplies the gate of the PMOS transistor Tr12 with the control voltage equal to the source voltage Vcc. As a result, the PMOS transistor Tr12 becomes a conductive state. The current of the PMOS transistor Tr9 is suppressed when the PMOS transistor Tr12 becomes the conductive state. The overshoot is suppressed which occurs at the circuit output terminal To. The output voltage becomes the voltage of the steady state after the short time duration lapses. A dumping factor of the circuit output terminal To may be optimized on the basis of the current strength suppressed by the PMOS transistor Tr12 and the time constant determined by the primary capacitor C2 and primary resistor R3. As a result, the output voltage smoothly transfers to the voltage of the steady state without a noise based on the switching of the PMOS transistor Tr12 inasmuch as the gate potential of the PMOS transistor Tr12 gradually falls in accordance with the time constant determined by the primary capacitance C2 and the primary resistance R3.

Figure 7:
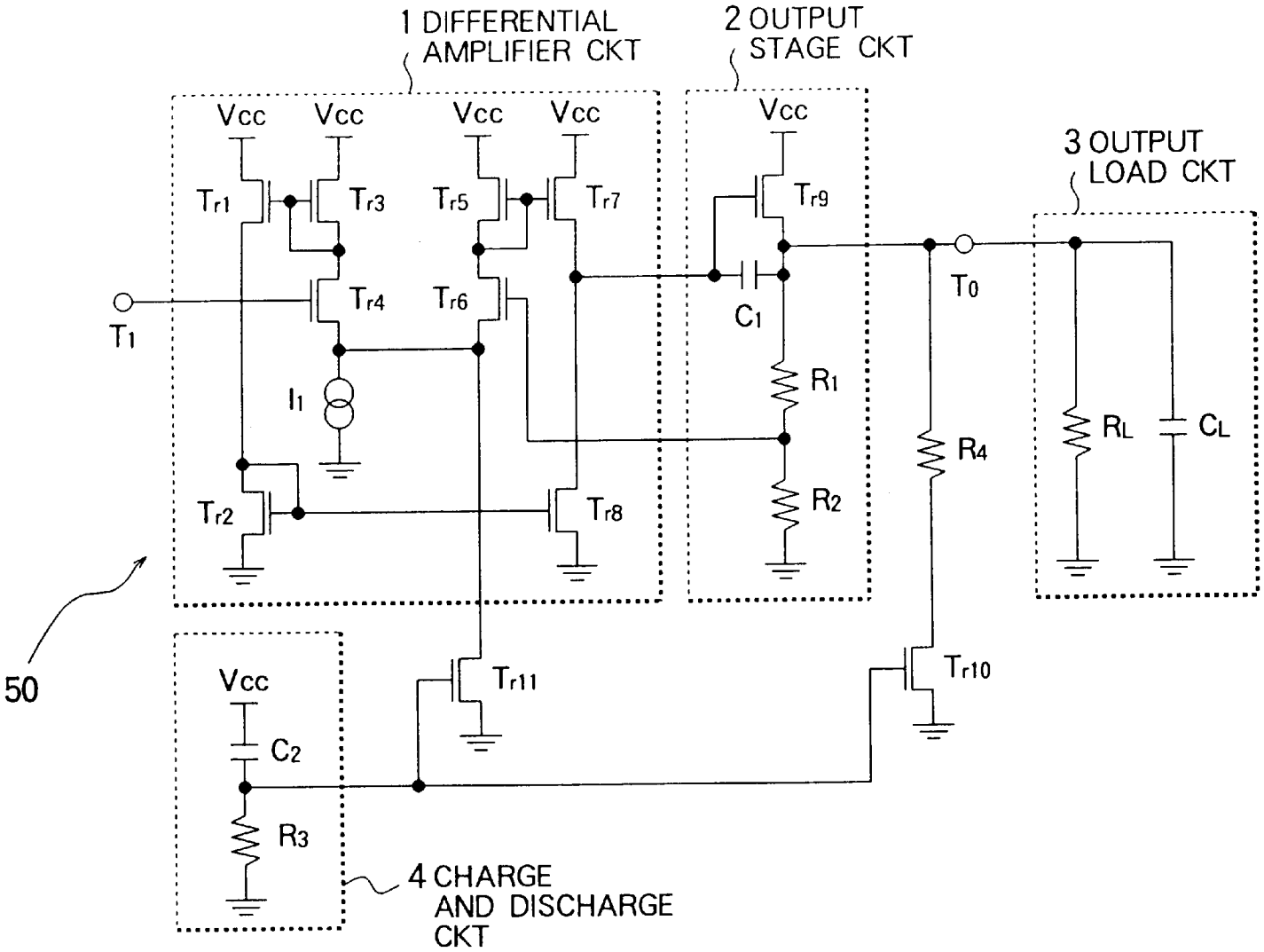
FIG. 7 is a circuit diagram of a constant-voltage circuit according to a fourth embodiment of this invention.

Referring to FIG. 7, description will proceed to a constant-voltage circuit according to a fourth embodiment of this invention. The illustrated constant-voltage circuit is different in structure from the constant-voltage circuit 20 illustrated in FIG. 4 and is therefore designated afresh by a reference numeral 50. The constant-voltage circuit 50 comprises similar parts which are designated by like reference symbols. The constant-voltage circuit 30 further comprises the NMOS transistor Tr11 illustrated in FIG. 5.

Just after the constant-voltage circuit 20 is put into operation, the primary capacitor C2 makes the gate potential of the NMOS transistor Tr10 become the source voltage Vcc. Similarly, the primary capacitor C2 makes the gate potential of the NMOS transistor Tr11 become the source voltage Vcc. In other words, the charge and discharge circuit 4 supplies the gates of the NMOS transistors Tr10 and Tr11 with the control voltage equal to the source voltage Vcc. As a result, the NMOS transistor Tr10 becomes a conductive state. The electric charges are discharged to the ground through the additional resistor R4 and the NMOS transistor Tr10. The NMOS transistor Tr11 becomes the conductive state. When the NMOS transistor Tr11 becomes the conductive state, the circuit current increases in the differential amplifier circuit 1. When the circuit current increases in the differential amplifier circuit 1, the PMOS transistor Tr9 quickly becomes the conductive state. Therefore, the output voltage quickly converges to the voltage of the steady state in cooperation with the NMOS transistors Tr10 and Tr11.

Figure 8:
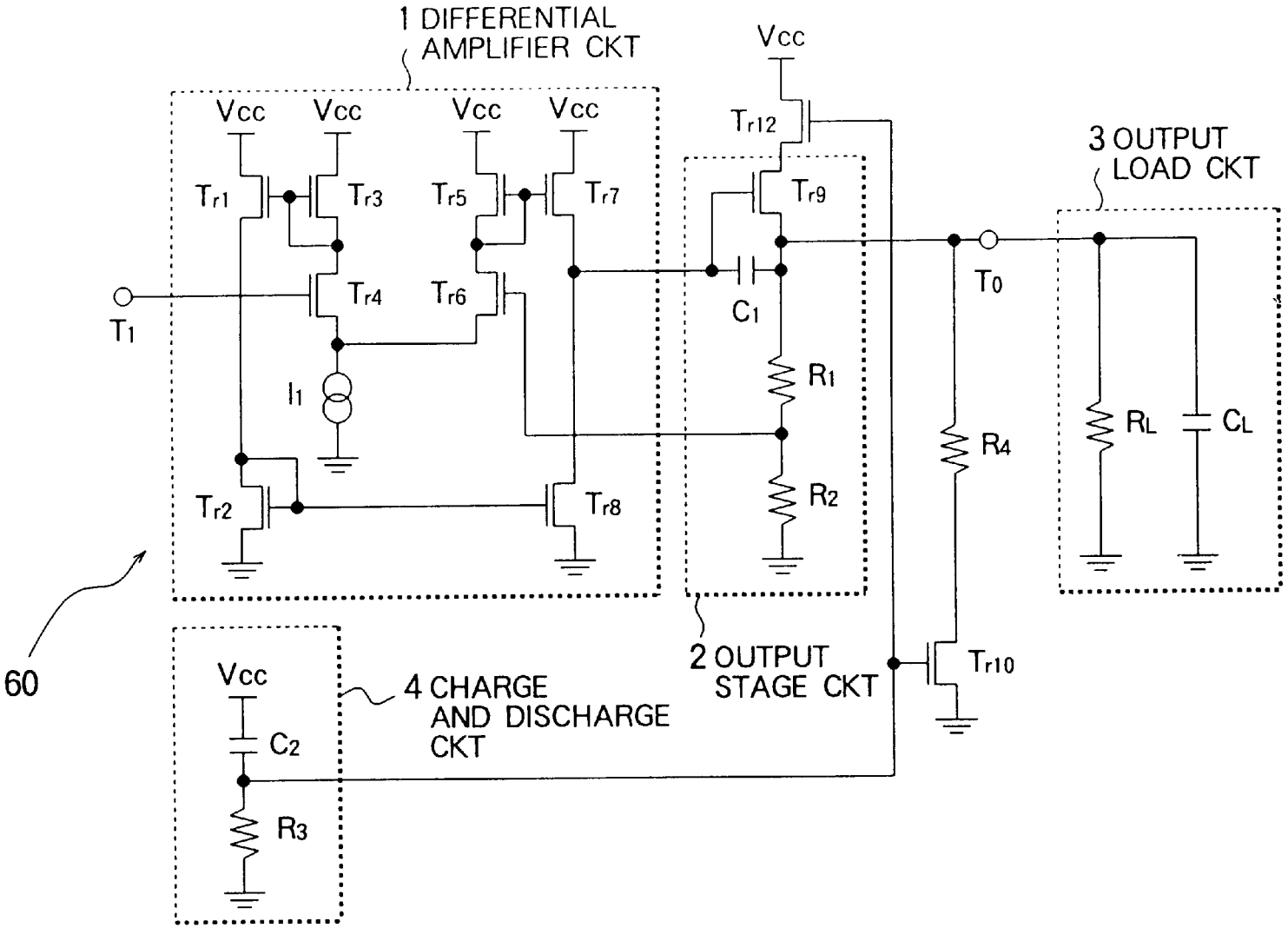
FIG. 8 is a circuit diagram of a constant-voltage circuit according to a fifth embodiment of this invention.

Referring to FIG. 8, description will proceed to a constant-voltage circuit according to a fifth embodiment of this invention. The illustrated constant-voltage circuit is different in structure from the constant-voltage circuit 20 illustrated in FIG. 4 and is therefore designated afresh by a reference numeral 60. The constant-voltage circuit 60 comprises similar parts which are designated by like reference symbols. The constant-voltage circuit 60 further comprises the PMOS transistor Tr12. The charge and discharge circuit 4 is connected to the gate of the PMOS transistor Tr12. The drain of the PMOS transistor Tr12 is connected to the source of the PMOS transistor Tr9. The source of the PMOS transistor Tr12 is supplied with the source voltage Vcc.

The illustrated constant-voltage circuit 40 outputs the output voltage as described in conjunction with FIG. 4.

Just after the constant-voltage circuit 40 is put into operation, the primary capacitor C2 makes the gate potential of the NMOS transistor Tr10 become the source voltage Vcc. Similarly, the primary capacitor C2 makes the gate potential of the PMOS transistor Tr12 become the source voltage Vcc. In other words, the charge and discharge circuit 4 supplies the gates of the NMOS transistor Tr10 and the PMOS transistor Tr12 with the control voltage equal to the source voltage Vcc. As a result, each of the NMOS transistor Tr10 and PMOS transistor Tr12 becomes the conductive state.

When the the NMOS transistor Tr10 becomes the conductive state, the electric charge is discharged from the circuit output terminal To to the ground through the additional resistor R4 and the NMOS transistor Tr10. The current of the PMOS transistor Tr9 is suppressed when the PMOS transistor Tr12 becomes the conductive state. Therefore, the overshoot is suppressed which occurs at the circuit output terminal To. In cooperation with the NMOS transistor Tr10 and the PMOS transistor Tr12, the output voltage becomes the voltage of the steady state after a very short time duration lapses.

Figure 9:
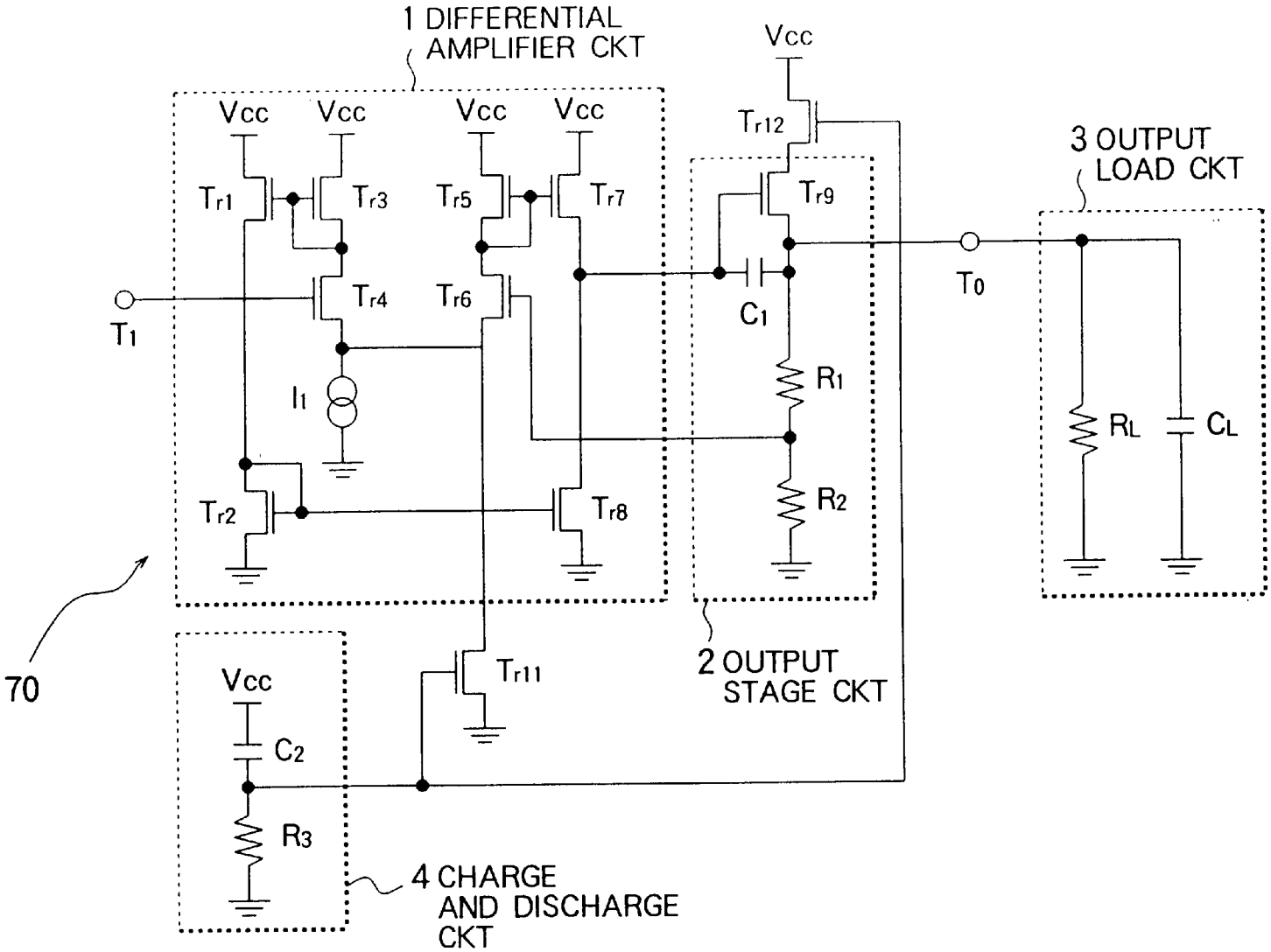
FIG. 9 is a circuit diagram of a constant-voltage circuit according to a sixth embodiment of this invention.

Referring to FIG. 9, description will proceed to a constant-voltage circuit according to a sixth embodiment of this invention. The illustrated constant-voltage circuit is different in structure from the constant-voltage circuit 30 illustrated in FIG. 5 and is therefore designated afresh by a reference numeral 70. The constant-voltage circuit 70 comprises similar parts which are designated by like reference symbols. The constant-voltage circuit 70 further comprises the PMOS transistor Tr12.

The charge and discharge circuit 4 is connected to the gate of the PMOS transistor Tr12. The drain of the PMOS transistor Tr12 is connected to the source of the PMOS transistor Tr9. The source of the PMOS transistor Tr12 is supplied with the source voltage Vcc.

The illustrated constant-voltage circuit 70 outputs the output voltage as described in conjunction with FIG. 5.

Just after the constant-voltage circuit 70 is put into operation, the primary capacitor C2 makes the gate potential of the NMOS transistor Tr11 become the source voltage Vcc. Similarly, the primary capacitor C2 makes the gate potential of the PMOS transistor Tr12 become the source voltage Vcc. In other words, the charge and discharge circuit 4 supplies the gates of the NMOS transistor Tr11 and PMOS transistor Tr12 with the control voltage equal to the source voltage Vcc. As a result, each of the NMOS transistor Tr11 and PMOS transistor Tr12 becomes the conductive state.

When the NMOS transistor Tr11 becomes the conductive state, the circuit current increases in the differential amplifier circuit 1. When the circuit current increases in the differential amplifier circuit 1, the PMOS transistor Tr9 quickly becomes the conductive state. On the other hand, the current of the PMOS transistor Tr9 is suppressed when the PMOS transistor Tr12 becomes the conductive state. Therefore, the overshoot is suppressed which occurs at the circuit output terminal To. In cooperation with the NMOS transistor Tr11 and the PMOS transistor Tr12, the output voltage becomes the voltage of the steady state after a very short time duration lapses.

Figure 10:
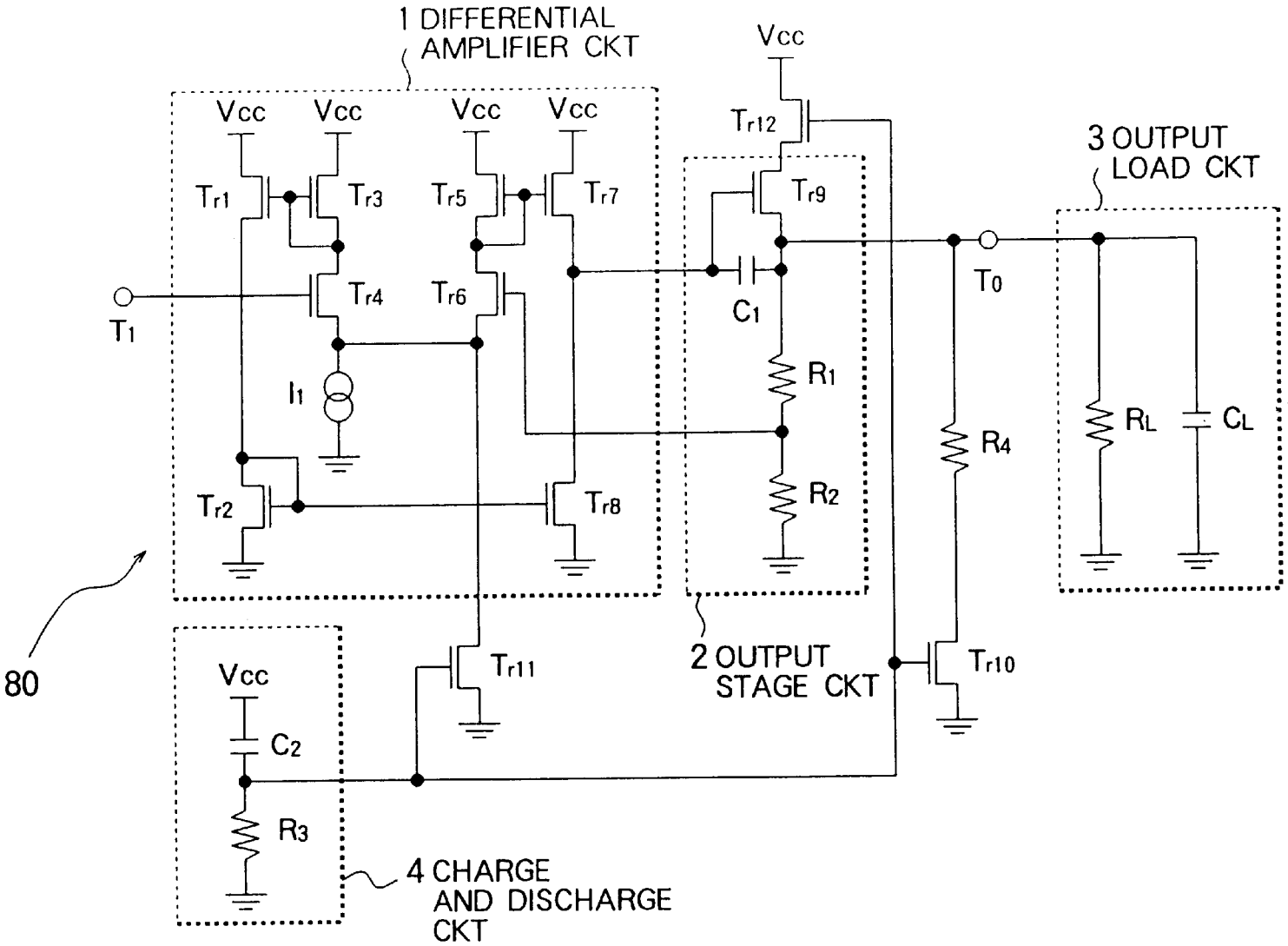
FIG. 10 is a circuit diagram of a constant-voltage circuit according to a seventh embodiment of this invention.

Referring to FIG. 10, description will proceed to a constant-voltage circuit according to a seventh embodiment of this invention. The illustrated constant-voltage circuit is different in structure from the constant-voltage circuit 20 illustrated in FIG. 4 and is therefore designated afresh by a reference numeral 80. The constant-voltage circuit 80 comprises similar parts which are designated by like reference symbols. The constant-voltage circuit 80 further comprises the NMOS transistor Tr11 and the PMOS transistor Tr12.

The charge and discharge circuit 4 is connected to the gate of the NMOS transistor Tr11. The drain of the NMOS transistor Tr11 is connected to the fourth and the sixth MOS transistors Tr4 and Tr6. The charge and discharge circuit 4 is connected to the gate of the PMOS transistor Tr12. The drain of the PMOS transistor Tr12 is connected to the source of the PMOS transistor Tr9. The source of the PMOS transistor Tr12 is supplied with the source voltage Vcc.

The illustrated constant-voltage circuit 80 outputs the output voltage as described in conjunction with FIG. 4.

Just after the constant-voltage circuit 80 is put into operation, the primary capacitor C2 makes the gate potential of the NMOS transistor Tr10 become the source voltage Vcc. Similarly, the primary capacitor C2 makes the gate potential of the NMOS transistor Tr11 become the source voltage Vcc. The primary capacitor C2 makes the gate potential of the PMOS transistor Tr12 become the source voltage Vcc. In other words, the charge and discharge circuit 4 supplies the gates of the NMOS transistors Tr10 and Tr11 and PMOS transistor Tr12 with the control voltage equal to the source voltage Vcc. As a result, each of the NMOS transistors Tr10 and Tr11 and PMOS transistor Tr12 becomes the conductive state.

When the the NMOS transistor Tr10 becomes the conductive state, the electric charge is discharged from the circuit output terminal To to the ground through the additional resistor R4 and the NMOS transistor Tr10. When the NMOS transistor Tr11 becomes the conductive state, the circuit current increases in the differential amplifier circuit 1. When the circuit current increases in the differential amplifier circuit 1, the PMOS transistor Tr9 quickly becomes the conductive state. On the other hand, the current of the PMOS transistor Tr9 is suppressed when the PMOS transistor Tr12 becomes the conductive state. The current of the PMOS transistor Tr9 is suppressed when the PMOS transistor Tr12 becomes the conductive state. Therefore, the overshoot is suppressed which occurs at the circuit output terminal To. In cooperation with the NMOS transistors Tr10 and Tr11 and the PMOS transistor Tr12, the output voltage becomes the voltage of the steady state after a very short time duration lapses.

While this invention has thus far been described in conjunction with the preferred embodiments thereof, it will readily be possible for those skilled in the art to put this invention into practice in various manners.

What is claimed is:

1. A constant-voltage circuit comprising:

differential amplifier means supplied with a reference voltage for producing an amplifier voltage in accordance with said reference voltage;

output means having a circuit output terminal for outputting an output voltage from said circuit output terminal in response to said amplifier voltage; and preventing means for preventing an overshoot at said circuit output terminal to control said output voltage to a constant voltage when a source voltage is supplied to said constant-voltage circuit, wherein said preventing means comprises:

overshoot preventing means for preventing said overshoot in response to a control signal to control said output voltage to said constant voltage; and supplying means for supplying said control signal to said overshoot preventing means when said source voltage is supplied to said constant-voltage circuit, wherein said supplying means comprises:

a primary resistor connected to ground; and a primary capacitor connected to said primary resistor at a connection point in series and supplied with said source voltage;

said control signal being supplied as a control voltage from said connection point to said overshoot preventing means.

2. A constant-voltage circuit as claimed in claim 1, wherein said overshoot preventing means comprises:

an additional resistor connected to said circuit output terminal; and an NMOS transistor connected to said additional resistor and ground, the gate of said NMOS transistor being connected to said connection point to be supplied with said control voltage.

3. A constant-voltage circuit as claimed in claim 1, wherein said overshoot preventing means comprises:

an NMOS transistor having a drain which is connected to said differential amplifier means, the source of said NMOS transistor being connected to ground, the gate of said NMOS transistor being connected to said connection point to be supplied with said control voltage.

4. A constant-voltage circuit as claimed in claim 1, wherein said overshoot preventing means comprises:

a PMOS transistor having a source which is supplied with said source voltage, the drain of said PMOS transistor being connected to said output means, the gate of said PMOS transistor being connected to said connection point to be supplied with said control voltage.

5. A constant-voltage circuit as claimed in claim 1, wherein said overshoot preventing means comprises:

an additional resistor connected to said circuit output terminal;

a first NMOS transistor connected to said additional resistor and ground, the gate of said first NMOS transistor being connected to said connection point to be supplied with said control voltage; and a second NMOS transistor having a drain which is connected to said differential amplifier means, the source of said second NMOS transistor being connected to ground, the gate of said second NMOS transistor being connected to said connection point to be supplied with said control voltage.

6. A constant-voltage circuit as claimed in claim 1, wherein said overshoot preventing means comprises:

an additional resistor connected to said circuit output terminal;

an NMOS transistor connected to said additional resistor and ground, the gate of said NMOS transistor being connected to said connection point to be supplied with said control voltage; and a PMOS transistor having a source which is supplied with said source voltage, the drain being connected to said output means, the gate of said PMOS transistor being connected to said connection point to be supplied with said control voltage.

7. A constant-voltage circuit as claimed in claim 1, wherein said overshoot preventing means comprises:

an NMOS transistor of which drain is connected to said differential amplifier means, the source of said NMOS transistor being connected to ground, the gate of said NMOS transistor being connected to said connection point to be supplied with said control voltage; and a PMOS transistor having a source which is supplied with said source voltage, the drain being connected to said output means, the gate of said PMOS transistor being connected to said connection point to be supplied with said control voltage.

8. A constant-voltage circuit as claimed in claim 1, wherein said overshoot preventing means comprises:

an additional resistor connected to said circuit output terminal;

a first NMOS transistor connected to said additional resistor and ground, the gate of said first NMOS transistor being connected to said connection point to be supplied with said control voltage;

a second NMOS transistor having a drain which is connected to said differential amplifier means, the source of said second NMOS transistor being connected to ground, the gate of said second NMOS transistor being connected to said connection point to be supplied with said control voltage; and a PMOS transistor having a source which is supplied with said source voltage, the drain being connected to said output means, the gate of said PMOS transistor being connected to said connection point to be supplied with said control voltage.

* * * * *